United States Patent [19]

Yablonski

[11] 4,250,677

[45] Feb. 17, 1981

[54] WALL STRUCTURE

[75] Inventor: Peter Yablonski, Saxton, Pa.

[73] Assignee: Guy D. Marcocci, Dudley, Pa. ; a part interest

[21] Appl. No.: 9,364

[22] Filed: Feb. 5, 1979

[51] Int. Cl.[3] ..... E04B 1/10

[52] U.S. Cl. ..... 52/233; 52/586; 52/592

[58] Field of Search ..... 52/233, 592, 483, 589, 52/591, 594, 475, 311, 313, 586

[56] References Cited

U.S. PATENT DOCUMENTS

| | | | |
|---|---|---|---|
| 1,910,326 | 5/1933 | Ford . | |
| 1,953,287 | 4/1934 | Bemis . | |
| 2,291,712 | 8/1942 | Hatton | 52/594 |
| 2,416,162 | 2/1947 | Drake | 52/233 |
| 2,426,802 | 9/1947 | Wachsmann . | |
| 2,525,659 | 10/1950 | Edson et al. | 52/233 |
| 2,619,686 | 12/1952 | Dombrowski | 52/233 |
| 2,875,478 | 3/1959 | Andre | 52/233 X |
| 3,104,427 | 9/1963 | Bearde . | |
| 3,527,005 | 9/1970 | Slavens | 52/233 X |
| 3,553,921 | 1/1971 | Breistein | 52/593 |

FOREIGN PATENT DOCUMENTS

| | | | |
|---|---|---|---|
| 630773 | 11/1961 | Canada | 52/592 |
| 606167 | 11/1934 | Fed. Rep. of Germany | 52/481 |
| 1071482 | 3/1954 | France | 52/483 |
| 435868 | 5/1948 | Italy | 52/586 |
| 213847 | 6/1967 | Sweden | 52/233 |
| 320173 | 2/1970 | Sweden | 52/586 |

*Primary Examiner*—J. Karl Bell

*Attorney, Agent, or Firm*—Cushman, Darby & Cushman

[57] ABSTRACT

A wall structure comprising a multiplicity of elongated wall panel forming members and elongated wall periphery forming members. The wall panel forming members are constructed to extend in horizontal courses with alternate courses being formed of siding elements and bar elements. Each siding element includes panel defining opposed faces simulating logs, opposed side portions having elongated grooves therein and opposed end portions having recesses therein forming lap sections. Each bar element includes opposed panel defining faces simulating mortar, opposed side portions having elongated tongues thereon of a size to engage within the elongated grooves in the side portions of the siding elements and opposed end portions having recesses therein forming lap sections similar to the lap sections in the end portions of the siding elements. The elongated periphery forming members include elongated corner, base plate, and top plate elements. Each elongated corner element includes end portion receiving faces intersecting one another at an approximate right angle, each of which has a width greater than the distance between the panel defining faces of the siding elements and an elongated channel shaped to receive the lap sections of the siding and bar elements spaced outwardly from the face juncture approximately one-half the width thereof. Each elongated base plate element has a planar lower side portion and an upper side portion formed with an elongated tongue or groove of a size to interengage with the groove or tongue of the initial course thereabove. Each elongated top plate element has an upper planar side portion and a lower side portion formed with an elongated tongue or groove of a size to interengage with the groove or tongue of the final course therebelow.

3 Claims, 3 Drawing Figures

82
16
10
80
78
12
84
20
2
2
32
30
34
14
28
48
106
46
50
44
104
108
110
26
3
3
22
100
96
102
24
98
74
72
18
70
76

WALL STRUCTURE

This invention relates to the construction of walls and particularly walls of the type utilized in dwellings and similar buildings.

While the provision of dwelling structures and the like is one of the basic necessities of life, and as such constitutes an old and well-developed art, there is always need for simplification and improvement in assemblies used as wall structures.

It is an object of the present invention to provide such an improvement. In accordance with the principles of the present invention, this objective is obtained by providing a multiplicity of elongated wall panel forming members made of wood and elongated wall periphery forming members, also made of wood. The wall panel forming members are preferably constructed so as to extend in horizontal courses with alternate courses being formed of siding elements and bar elements. Each of the siding elements includes panel defining opposed surfaces simulating logs. Each of the bar elements includes opposed panel defining faces simulating mortar. Each of the siding elements includes opposed side portions having elongated grooves therein and opposed end portions having recesses therein forming lap sections. The bar elements include opposed side portions having elongated tongues thereon of a size to engage within the elongated grooves in the side portions of the siding elements and opposed end portions having recesses forming lap sections similar to the lap sections in the end portions of the siding elements. In this way, the elongated wall panel forming members are arranged so that in the event that it becomes necessary or desirable to use a plurality of either sliding elements or bar elements in any given course, the end-to-end connection between the plurality of elements in the course will be a lapped connection by interengaging the lap sections on the end portions thereof. In addition, the arrangement provides interengagement between courses through the interengagement of the tongues and grooves of the elements thereof. The panel defining opposed faces of the siding and bar elements when assembled in the effective manner indicated above present two finished wall surfaces which are configured to simulate a log cabin effect.

The elongated wall periphery forming members include one or more vertical corner elements having end portion receiving faces intersecting one another at an approximate right angle. Each of these faces has a width greater than the distance between the panel defining faces of the siding elements and an elongated channel shaped to receive the lap sections of the siding and bar elements spaced outwardly from the face juncture approximately one-half the width thereof. The wall periphery forming members also include a bottom base plate element having a side portion formed with either a groove to receive a tongue where the bar elements are used as the first course or a tongue where the siding elements are used as the first course. A top plate element is also included which has a lower side portion formed with an elongated groove where the bar elements are used as the uppermost course or a tongue where the siding elements are used as the top course. The corner elements, top plate element and base plate element constitute exterior wall periphery forming members and in addition interior wall periphery forming members are provided where interior openings in the wall structure are desired, as, for example, door openings or window openings. The vertical interior periphery forming members include plate elements which are formed essentially like one-half of the corner elements whereas the top and bottom interior wall periphery forming members are constructed in a manner similar to the top plate and base plate elements respectively.

These and other objects of the present invention will become more apparent during the course of the following detailed description and appended claims.

The invention may best be understood with reference to the accompanying drawings wherein an illustrative embodiment is shown.

Figure 1:
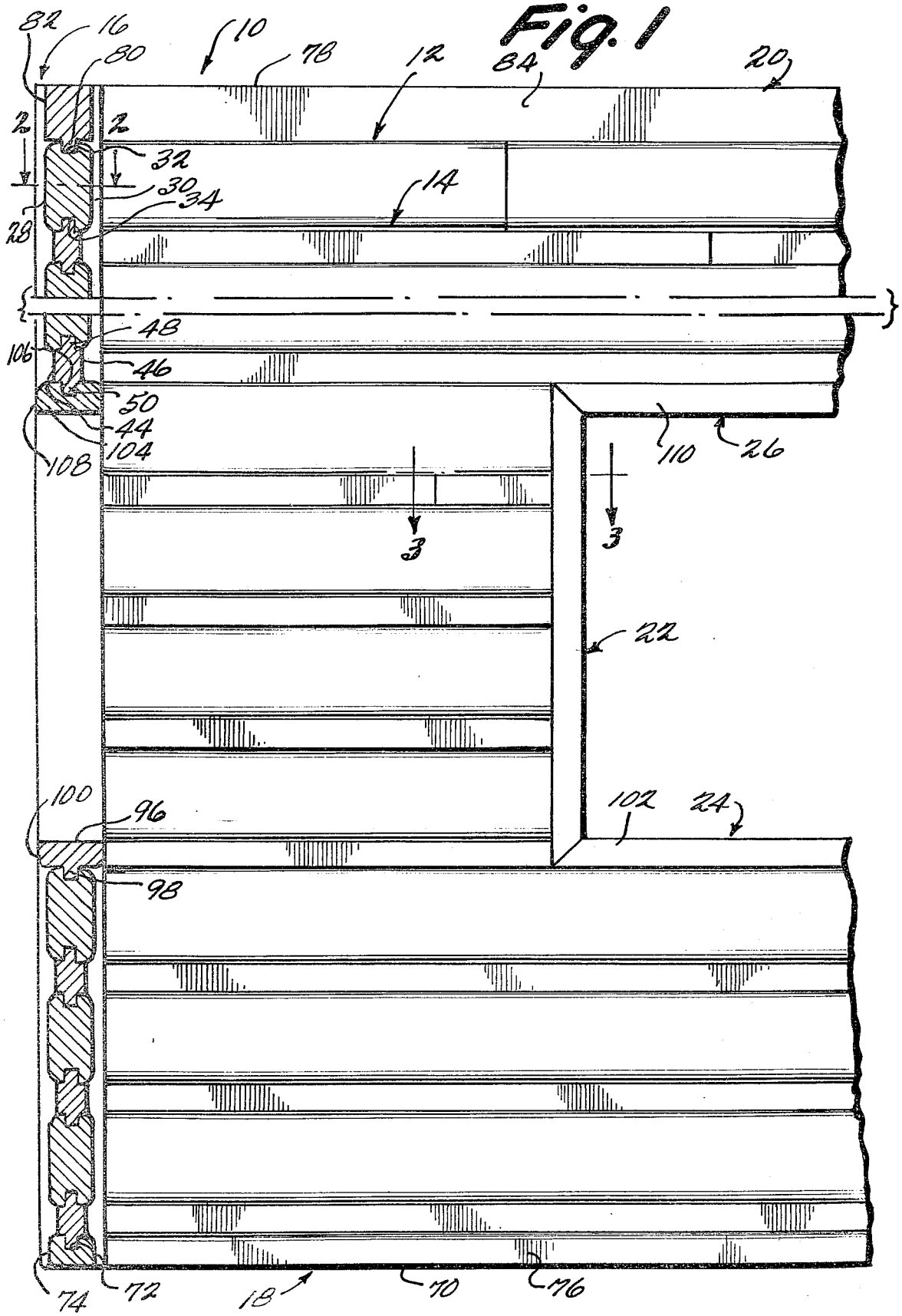
FIG. 1 is a fragmentary vertical sectional view of a wall assembly embodying the principles of the present invention.

Referring now more particularly to the drawings, there is shown in FIG. 1 thereof a wall assembly, generally indicated at 10, which is constructed in accordance with the principles of the present invention. It will be understood that the wall assembly 10 is useful in forming a part of a total building construction such as a dwelling or similar construction. The portion shown in FIG. 1 illustrates fragments of two intersecting wall sections, both wall sections being constructed in a substantially identical fashion. Since the two wall sections are identical, it will be understood that a description of one of the wall sections will suffice to provide an understanding of the construction and operation of both.

In accordance with the principles of the present invention, a wall section of the wall assembly 10 is constructed of a multiplicity of elongated wall panel forming members and elongated wall periphery forming members. The wall panel forming members serve to provide the main body of the wall section and are arranged and constructed to extend in horizontal courses with alternate courses being formed by siding elements 12 and bar elements 14 respectively. The elongated wall periphery forming members include exterior members in the form of elongated vertically extending corner elements 16, elongated horizontally extending bottom base plate elements 18 and elongated horizontally extending top plate elements 20. For purposes of defining openings in the wall section such as a window or a door, interior wall periphery forming members are provided which include vertically extending frame elements 22 and horizontally extending frame elements 24 and 26.

Each siding element 12 includes opposed panel defining faces 28 and 30, opposed side portions having elongated grooves 32 and 34 extending downwardly into the upper side portion and upwardly into the lower side portion respectively. Each siding element 12 also includes opposed end portions having recesses 36 and 38 therein (see FIG. 2) forming lap sections 40 and 42 respectively. Each siding element 12 between the lap sections 40 and 42 of the end portions thereof is of uniform cross-sectional configuration, such cross-sectional configuration being symmetrical about a medial vertical line.

Each bar element 14 is formed with opposed panel defining faces 44 and 46 and opposed upper and lower side portions having elongated tongues 48 and 50 therein respectively. Each bar element 14 also is provided with opposed end portions having recesses 52 and 54 forming lap sections 56 and 58. The bar elements, like the siding elements, are of uniform cross-sectional configuration throughout their longitudinal extent between the lap sections 56 and 58. As before, the cross-section is symmetrical about a medial line.

The cross-sectional configuration of each bar element 14 is essentially rectangular with the rectangular configuration of the tongues extending upwardly from the top side portion and downwardly from the bottom side portion. The opposed panel defining faces are preferably planar and parallel to one another so that when assembled in operative position in relation to the sliding elements 12 simulate mortar. The panel defining faces of the siding elements are essentially of opposed convex configuration so that when arranged in operative relation with respect to the bar elements simulate logs. The main central parts of the faces 28 and 30 are preferably planar and parallel with the upper and lower portions extending inwardly to the upper and lower side portions to form the convex configuration through arcuate configurations. It will be noted that the distance between the planar faces 44 and 46 of each bar element is less than the distance between the planar portions of the faces 28 and 30 of each siding element. The upper and lower arcuate configurations of the siding element faces 28 and 30 extend outwardly beyond the planar faces of the bar elements. The upper and lower side portions of the siding elements have a width substantially equal to the width of the bar elements. In this regard, it will be noted that the rectangular cross-sectional configuration of the tongues 48 and 50 of the bar elements conform with the rectangular cross-sectional configuration of the grooves 32 and 34. When placed in horizontal courses in operative position within a wall section the exterior tongue 48 of each course of bar elements 14 will engage within the lower groove 34 of the siding elements 12 of the next adjacent course with the adjacent horizontal extending sections of the side portions being disposed in abutting engagement.

It will also be understood that where the length of the horizontal course exceeds the length of either the available bar elements or the available siding elements, two or more of these elements may be utilized to form the course. In cases of this type, the adjacent end portions of the elements are disposed so that their lap portions are in lapped relation. A lap joint of two siding elements is shown in FIG. 2, whereas a lap joint of two bar elements is shown in FIG. 3.

Figure 2:
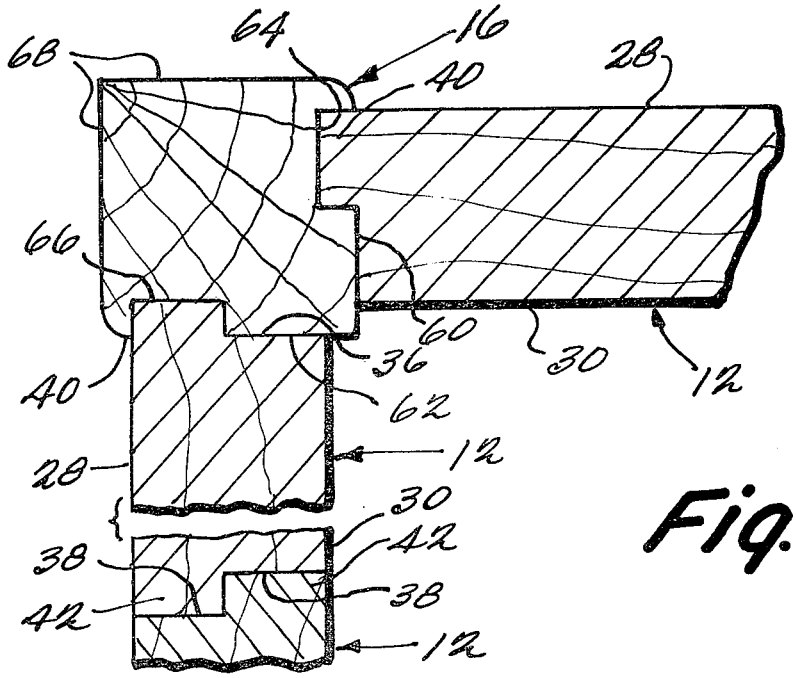
FIG. 2 is an enlarged, fragmentary sectional view through the corner of the wall assembly shown in FIG. 1 as indicated by the line 2—2.
Figure 3:
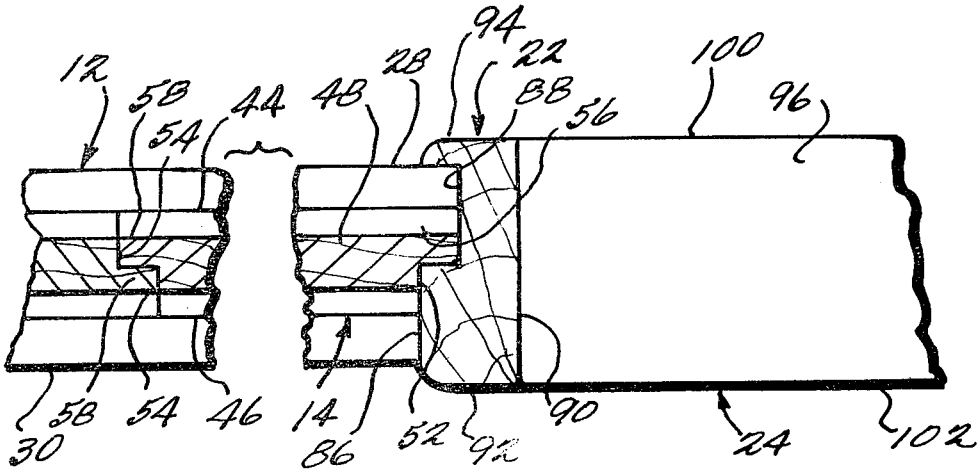
FIG. 3 is an enlarged fragmentary sectional view taken along the line 3—3 of FIG. 1.

Referring now more particularly to FIG. 2, the corner element 16 constructed in accordance with the principles of the present invention comprises a wooden post of essentially square cross-sectional configuration uniform through its vertical extent, having two end portion receiving faces 60 and 62 disposed essentially at right angles with respect to each other and intersecting one another. Formed in the face 60 in the half thereof disposed outwardly from the junction with the face 62 is an elongated continuous vertically extending channel 64 of a size to receive therein the lap sections 40 and 42 of the siding elements 12 and, of course, the smaller lap sections 56 and 58 of the bar elements 14. In a similar fashion, the other face 62 has formed in the half thereof disposed outwardly from the junction with face 60 a continuous elongated channel 66 which likewise is of a size to receive therein the lap sections 40, 42, 56 and 58.

It will be noted that when the corner element is secured in lapped relation with respect to the panel forming members including siding elements 12 and bar elements 14 the corners of the associated room section are finished both interiorly along the junctions of the two faces 60 and 62 as well as exteriorly by intersecting outer faces 68.

Each base plate element 18 has a planar lower side portion 70 which extends horizontally and faces downwardly for engaging the foundation surface on which the wall structure is to be built. The opposite upper side portion of each base plate element is formed with an elongated groove 72 of a size to receive a tongue 50 of a bar element 46 defining the initial course. It will be understood that the upper side portion of the base element may be provided with a tongue rather than the groove of a size to interengage with a groove 34 of a siding element. The base plates also include opposed base defining surfaces 74 and 76.

Each top plate element 20 includes an upper side portion 78 of planar configuration. As shown, the side portion is disposed horizontally and faces upwardly to receive roof trusses or similar structural elements forming a ceiling or roof in conjunction with the wall structure. Each top plate element 20 also includes a lower side portion having a tongue 80 extending downwardly therefrom. Here again, it will be appreciated that tongue 80 can be replaced with a groove if desired. The tongue 80 is of a size to interengage with a groove 34 in the siding elements 12 defining the final course. Each top plate element 20 also includes opposed top plate defining surfaces 82 and 84.

Referring now more particularly to FIG. 3, each vertically extending frame element 22 has a construction which is essentially one-half of the corner element 16. To this end, each elongated vertical frame element 22 includes an end portion receiving face 86 having an elongated channel 88 formed therein which extends vertically within one horizontal half of the face 70. The channel 88 is thus positioned within the face 86 in the same relationship as the channel 64 with respect to the face 60, or the channel 66 with respect to the face 62. Each vertical frame element 22 also includes an opposed planar interior opening defining face 90 and opposed frame defining faces 92 and 94.

As best shown in FIG. 1, the horizontal frame elements 24 and 26 are constructed so as to be similar to either the base element 18 or the top plate element 20. As shown, the lower horizontal frame element 24 includes an upwardly facing interior opening defining planar face 96, an opposed lower side portion having a tongue 98 of a size to engage within a groove 34 of an adjacent course and frame defining faces 100 and 102. The upper frame element 26 includes a downwardly facing interior opening defining a planar face 104, an opposed side portion formed with a groove 106 of a size to receive a tongue 50 of an adjacent course, and opposed frame defining faces 108 and 110. It will be understood that the upper and lower frame elements 24 and 26 may be exchanged to accommodate the position of the opening in the wall structure in relation to the adjacent course.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A wall structure comprising a multiplicity of elongated wall panel forming members and elongated wall periphery forming members, said wall panel forming members being constructed to extend in horizontal courses with alternate courses being formed of siding elements and bar elements, each of said siding elements including panel defining opposed faces simulating logs, opposed side portions having elongated grooves therein and opposed end portions having recesses therein forming lap sections, said bar elements including opposed panel defining faces simulating mortar, opposed side portions having elongated tongues thereon of a size to engage within the elongated grooves in the side portions of said siding elements and opposed end portions having recesses therein forming lap sections similar to the lap sections in the end portions of said siding elements, said elongated periphery forming members including elongated corner, base plate, and top plate elements, each elongated corner element having end portion receiving faces intersecting one another at an approximate right angle, each of said faces having a width greater than the distance between the panel defining faces of said siding elements and an elongated channel shaped to receive the lap sections of said siding and bar elements spaced outwardly from the face juncture approximately one-half the width thereof, each elongated base plate element having a planar lower side portion and an upper side portion formed with an elongated tongue or groove of a size to interengage with the groove or tongue of the initial course thereabove, each elongated top plate element having an upper planar side portion and a lower side portion formed with an elongated tongue or groove of a size to interengage with the groove or tongue of the final course therebelow, each of said siding and bar elements being of uniform cross-sectional configuration between the lap sections of the end portions thereof which cross-section is symmetrical about a medial vertical line, the panel defining faces of each bar element being planar and parallel to each other, the tongues of each bar element having a width less than the distance between the panel defining faces thereof with the remainder of each side portion thereof being constituted by a pair of aligned planar surfaces each of which extends from the associated tongue to one of the panel defining faces thereof, each side portion of each siding element having a pair of aligned planar surfaces of a size to engage the pair of aligned planar surfaces of the adjacent bar element, each panel defining face of each siding element including a planar central vertical surface and a convexly arcuate surface extending therefrom to one of each of the pairs of adjacent planar surfaces.

2. A wall structure comprising a multiplicity of elongated wall panel forming members and elongated wall periphery forming members, said wall panel forming members being constructed to extend in horizontal courses with alternate courses being formed of siding elements and bar elements, each of said siding elements including panel defining opposed faces simulating logs, opposed side portions having elongated grooves therein and opposed end portions having recesses therein forming lap sections, said bar elements including opposed panel defining faces simulating mortar, opposed side portions having elongated tongues thereon of a size to engage within the elongated grooves in the side portions of said siding elements and opposed end portions having recesses therein forming lap sections similar to the lap sections in the end portions of said siding element, said elongated periphery forming members including elongated corner, base plate, and top plate elements, each elongated corner element having end portion receiving faces intersecting one another at an approximate right angle, each of said faces having a width greater than the distance between the panel defining faces of said siding elements and an elongated channel shaped to receive the lap sections of said siding and bar elements spaced outwardly from the face juncture approximately one-half the width thereof, each elongated base plate element having a planar lower side portion and an upper side portion formed with an elongated tongue or groove of a size to interengage with the groove or tongue of the initial course thereabove, each elongated top plate element having an upper planar side portion and a lower side portion formed with an elongated tongue or groove of a size to interengage with the groove or tongue of the final course therebelow, said elongated periphery forming members further including vertical and horizontal interior frame elements, each horizontal interior frame element having a side portion formed with a tongue or groove of a size to interengage with the groove or tongue of an adjacent course and an opposed planar interior opening defining face, each vertical interior frame element including an end portion receiving face having an elongated vertical channel formed in one horizontal half thereof shaped to receive the lap sections of said siding and bar elements and an opposed planar interior opening defining face.

3. A wall structure as defined in claim 2, wherein each of said siding and bar elements is of uniform cross-sectional configuration between the lap sections of the end portions thereof which cross-section is symmetrical about a medial vertical line, the panel defining faces of each bar element being planar and parallel to each other, the tongues of each bar element having a width less than the distance between the panel defining faces thereof with the remainder of each side portion thereof being constituted by a pair of aligned planar surfaces each of which extends from the associated tongue to one of the panel defining faces thereof, each side portion of each siding element having a pair of aligned planar surfaces of a size to engage the pair of aligned planar surfaces of the adjacent bar element, each panel defining face of each siding element including a planar central vertical surface and a convexly arcuate surface extending therefrom to one of each of the pairs of adjacent planar surfaces.

* * * * *